US008186665B2

(12) United States Patent
Akema

(10) Patent No.: US 8,186,665 B2
(45) Date of Patent: May 29, 2012

(54) LOCKING DEVICE OF PAPER FEED TRAY AND IMAGE FORMING APPARATUS

(75) Inventor: Hiroshi Akema, Miyagi (JP)

(73) Assignee: Ricoh Company, Limited, Tokyo (JP)

( * ) Notice: Subject to any disclaimer, the term of this patent is extended or adjusted under 35 U.S.C. 154(b) by 135 days.

(21) Appl. No.: 12/654,577

(22) Filed: Dec. 23, 2009

(65) Prior Publication Data

US 2010/0156028 A1 Jun. 24, 2010

(30) Foreign Application Priority Data

Dec. 24, 2008 (JP) ..... 2008-327006

(51) Int. Cl.
*B65H 3/44* (2006.01)

(52) U.S. Cl. ..... 271/9.12; 271/162; 312/298; 312/308

(58) Field of Classification Search ..... 271/9.11, 271/9.12, 162; 312/215, 298, 333, 308
See application file for complete search history.

(56) References Cited

U.S. PATENT DOCUMENTS 5,195,734 A 3/1993 Tanabe

FOREIGN PATENT DOCUMENTS

JP 06135640 A * 5/1994
JP 2831458 9/1998

OTHER PUBLICATIONS

Abstract of JP 04179634, Jun. 26, 1992.

* cited by examiner

*Primary Examiner* — Michael McCullough
(74) *Attorney, Agent, or Firm* — Harness, Dickey & Pierce, P.L.C.

(57) ABSTRACT

A locking device locks or separates a first paper feed tray to a second paper feed tray in a state where the first paper feed tray and the second paper feed tray being arranged in parallel at a storage position of an image forming apparatus. The locking device includes an engaging mechanism that can be set to an interlocked state. When the engaging mechanism is in an interlocked state, and when a drawing tray is drawn out from the storage position, a drawn tray is drawn out after the drawing tray is drawn out for a predetermined distance from the storage position.

22 Claims, 13 Drawing Sheets

α: GRADIENT OF SLOPE

F: FORCE APPLIED TO SLOPE BY ROLLER

F1: VERTICAL COMPONENT OF F WITH RESPECT TO SLOPE

F2: PARALLEL COMPONENT OF F WITH RESPECT TO SLOPE

F4: MAIN COMPONENT OF HORIZONTAL FORCE ACTING ON PAPER FEED TRAY

LOCKING DEVICE OF PAPER FEED TRAY AND IMAGE FORMING APPARATUS

CROSS-REFERENCE TO RELATED APPLICATIONS

The present application claims priority to and incorporates by reference the entire contents of Japanese Patent Application No. 2008-327006 filed in Japan on Dec. 24, 2008.

BACKGROUND OF THE INVENTION

1. Field of the Invention

The present invention relates to a locking device of a paper feed tray and an image forming apparatus, and, more particularly to a locking device of a paper feed tray including an engaging member arranged in one paper feed tray and a to-be-engaged member arranged in the other paper feed tray, of paper feed trays arranged in parallel at storage positions of an image forming apparatus, and to an image forming apparatus including the locking device. The locking device can set to an interlocked state where the engaging member and the to-be-engaged member are in an engageable state and both of the paper feed trays are coupled to transmit a drawing force of the one paper feed tray to the other paper feed tray so that both of the paper feed trays can be drawn out together, and to a separated state where the engaging member and the to-be-engaged member are not engaged with each other, and the paper feed trays are separated from each other so that each paper feed tray can be drawn out individually.

2. Description of the Related Art

Some paper feeding apparatuses used in a copying machine and the like include a paper feed tray referred to as a tandem tray to which two paper feed trays are positioned in parallel. In the paper feeding apparatus including such a tandem tray, if a paper feed tray on a paper feed unit side is designated as a first paper feed tray, and the other paper feed tray is designated as a second paper feed tray, sometimes a locking device is provided. With the locking device, the paper feed trays can be coupled to or de-couples from each other according to circumstances. In this configuration, when the first and second paper feed trays are not feeding sheets, by coupling the first and second paper feed trays together with the locking device, both the feed trays can be drawn out together. On the other hand, when the first paper feed tray is feeding sheets, by de-coupling the first and second paper feed trays by releasing the locking device, only the second paper feed tray can be drawn out. A paper feed tray is drawn out from the paper feeding apparatus when replenishing sheets.

Japanese Patent No. 2831458 discloses an image forming apparatus in which each paper feed tray of a so-called tandem tray including a first paper storage unit (a first paper feed tray) and a second paper storage unit (a second paper feed tray) is formed of an independent tray member, a guide rail is installed so that these paper feed trays are drawn out at a substantially right angle to a sheet transport direction (forward of the machine), and a locking mechanism that couples and integrates the first and second paper feed trays is provided so that when the locking mechanism is operated, if one paper feed tray is drawn out, the other paper feed tray can be drawn out together.

The image forming apparatus disclosed in Japanese Patent No. 2831458 is explained below. FIG. 7 is a sectional view of an image forming apparatus 1 (copying machine) with a tandem tray incorporated therein. In the image forming apparatus 1, a manuscript is set on a contact glass 10, a surface of the manuscript is irradiated with light generated by a light source 9, light reflected from the manuscript is directed to a photoconductor 12 by an optical system 11 thereby forming a latent image on the photoconductor 12. The latent image on the photoconductor 12 is developed by a developing device 14 into a visual image. The visual image on the photoconductor 12 is transferred onto a printing paper P in a transfer and separation unit 15 and fixed to the printing paper P by a fixing device 17. In FIG. 7, reference numeral 13 denotes a charger that charges the photoconductor 12, 16 denotes a cleaning apparatus that removes residual toner on the photoconductor 12, 18 denotes a pair of registration rollers that performs positioning of printing paper, 19 denotes a large paper feed tray that stores large printing paper, and 20 and 21 denote first and second paper feed trays, respectively. The first and second paper feed trays 20 and 21 form the tandem tray. The first and second paper feed trays 20 and 21 store printing paper P1 and P2, respectively. Further, reference numeral 22 denotes a printing-paper feed path, 23 denotes a manual paper feed unit, and reference characters L1, L2, L3, L4, and L5 denote guide rails, and reference characters P1 and P2 denote printing paper.

A configuration of a paper feed unit of the image forming apparatus 1 is explained next. In the paper feed unit, a shift mechanism that shifts the printing paper from the one paper feed tray to the other paper feed tray is provided in the paper feed unit in addition to a locking mechanism. FIG. 8 is a plan view of an entire configuration of the paper feed unit at the time of storing the paper feed trays in the image forming apparatus shown in FIG. 7. FIG. 9 is a front view of the transfer paper storage unit shown in FIG. 8. FIGS. 10A and 10B depict a state of the locking mechanism at the time of storage in a conventional image forming apparatus, where FIG. 10A is a schematic diagram of a coupled state and FIG. 10B is a schematic diagram of an operation to shift from a released state to the coupled state. FIGS. 11A and 11B depict a movement of the two paper feed trays in the conventional image forming apparatus, where FIG. 11A is a plan view of a state where coupling is released and one of the paper feed trays is drawn out, and FIG. 11B is a plan view of a state where the two paper feed trays are drawn out in the coupled state.

In FIGS. 8 and 9, reference numeral 25 denotes a transfer path provided between the first paper feed tray 20 and the second paper feed tray 21 for transferring the transfer paper P2 from the second paper feed tray 21 to the first paper feed tray 20. Reference numeral 27 denotes a handle provided in the second paper feed tray 21, 34 and 35 denote a pair of side fences, 36 denotes a back fence, 37 denotes a rotatable bottom plate (capable of rising) with one end 37*b* engaging with the first paper feed tray 20, 38 denotes a solenoid for evacuating the back fence 36 from the transfer path 25, 39 denotes a rising unit that drives the bottom plate 37, and 40 denotes a bottom plate adhered to the second paper feed tray 21. Reference numeral 41 denotes a movable back fence, which is a transfer unit that transfers the transfer paper P2 to the first paper feed tray 20 collectively by pressing substantially a central part of a rear end of the transfer paper P2 stacked on the bottom plate 40. Reference numeral 42 denotes a hole formed in the bottom plate 40 so that a pressing unit 41*a* of the movable back fence 41 can move, and 43 denotes a wire coupled with a coupling unit 41*b* at a bottom end of the pressing unit 41*a*. Reference numerals 44 to 47 denote a pulley that stretches the wire 43 in a tense state, and 48 denotes a reversible motor that rotates the pulley 45 forward and backward. Reference numeral 49 denotes a home position sensor and 50 denotes a positioning sensor, which detect the movement of a protruding portion 41*c* of the movable back fence 41. Reference numeral 51 denotes a paper-bundle detection sensor that detects presence of the transfer paper P2 on the bottom plate 40. Further, reference numeral 52 denotes a pressing plate with one end thereof passes through a hole 20*a* in the paper feed tray 20 to abut against the bottom plate 37, 53 denotes a pressurizing shaft that supports the other end of the pressing plate 52, and 54 denotes a reversible motor that drives a sector gear 53*a* provided at a shaft end of the pressurizing shaft 53. Further, reference numeral 60 denotes a locking mechanism that sets to a locked state where the first and second paper feed trays 20 and 21 are coupled with each other or an unlocked state where engagement of both of the paper feed trays is released, 61 denotes a lock-releasing solenoid, 62 denotes an engagement claw member, 63 denotes a shaft of the engagement claw member, 64 denotes a torsion spring, 65 denotes a plunger of the solenoid, 66 denotes a release lever, 67 denotes a return spring, and 68 denotes a support hole for the engagement claw member.

In such an apparatus, when the locking mechanism 60 is set to the locked state, as shown in FIGS. 10A and 11A, the engagement claw member 62 engages with the support hole 68, to couple the first and second paper feed trays 20 and 21 with each other. By pulling the handle 27 of the second paper feed tray 21, the paper feed trays 20 and 21 can be drawn out.

On the other hand, when the locking mechanism 60 is set to the unlocked state, as shown in FIGS. 10B and 11B, in a state where the engagement claw member is released (in a portion indicated by a dotted line), when the handle 27 of the second paper feed tray 21 is pulled, only the second paper feed tray 21 is drawn out. From this state, when the second paper feed tray 21 is to be stored, the engagement claw member moves in a counter-clockwise direction as shown in FIG. 10B, and when reaching a coupling position, the engagement claw member is fitted into the support hole due to a spring force, so that the two paper feed trays become a coupled state.

In the image forming apparatus 1, a paper-feed-tray pushing device is provided for pushing out the paper feed tray to the outside when the locking mechanism that positions and fixes the paper feed tray in the image forming apparatus is released. FIGS. 12A and 12B depict the paper-feed-tray pushing device, where FIG. 12A is a schematic diagram of a state where the paper feed tray is stored, and FIG. 12B is a schematic diagram of a state where the paper feed tray is pushed out. In this example, the pushing device includes a paper-feed-tray locking device 80 that fixes the paper feed tray 20, and a compression spring 90 that pushes out the paper feed tray 20.

The paper-feed-tray locking device 80 can operate the paper feed tray to a locked state where movement of the paper feed tray 20 toward a near side (to the right in FIGS. 12A and 12B) is restricted or to an unlocked state where the movement of the paper feed tray 20 toward the near side is allowed, and is provided at an end on the near side of the paper feed tray 20. The paper-feed-tray locking device 80 is constituted by arranging an arm member 81 rotatably around a rotation shaft 83, which includes, at one end thereof, an engagement claw 82 that engages with a protrusion 71 of an image forming apparatus body 70 to restrict the paper feed tray 20 from being drawn out, and at the other end, a handle 84 for operating the paper-feed-tray locking device 80. The paper-feed-tray locking device 80 becomes the locked state by pushing in the paper feed tray 20 and engaging the engagement claw 82 with the protrusion 71, or the unlocked state by operating the handle 84 to rotate the arm member 81 to thereby release the engagement between the engagement claw 82 and the protrusion 71.

The compression spring 90 is compressed due to insertion of the paper feed tray 20, to energize the paper feed tray 20 toward the near side. As shown in FIG. 12A, therefore, in a state where the paper feed tray 20 is inserted into the image forming apparatus body 70, a force toward the near side is applied to the paper feed tray 20 due to the compression spring 90, and the engagement claw 82 engages with the protrusion 71 to hold an arrangement position of the paper feed tray 20.

When the paper feed tray is to be drawn out, the handle 84 is operated to rotate the arm member 81, to thereby remove the engagement claw 82 from the protrusion 71. Due to this operation, the paper feed tray 20 moves toward the near side due to an energizing force of the compression spring 90.

Thus, a user performs only one operation of operating the handle 84. Mechanically, however, two operations of releasing the lock of the paper-feed-tray locking device 80 and drawing out the paper feed tray 20 are performed, and because actions of forces thereof are different, an operating force changes along the way. Therefore, there is such a problem that if the handle is operated with a stronger force because the operating force is large, the necessary operating force decreases abruptly and the paper feed tray may spring out swiftly, or if the handle is operated with a weaker force because the operating force is small, the necessary operating force increases abruptly and user's hand may come off the handle. Under such circumstances, the user may have a feeling of danger.

FIGS. 13A to 13D depict another example paper-feed-tray pushing device, where FIG. 13A is a schematic diagram of a stored state of the paper feed tray, FIG. 13B depicts a state of the force in the stored state, FIG. 13C is a schematic diagram of a pushed state of the paper feed tray, and FIG. 13D depicts a state of the force in the pushed state. In the pushing device according to this example, a slope member 120 is arranged at an end of the paper feed tray 20 on a back side thereof, and the slope member 120 is pressed by a pressing member 130 to energize the paper feed tray 20 to the back side or the near side. Further, a handle 110 is arranged on the near side of the paper feed tray 20, and a stopper 72 that restricts movement of the paper feed tray 20 toward the back is formed on the back side of the image forming apparatus body 70. The slope member 120 includes two slopes 121 and 123 having different inclinations arranged at an end of a connecting part 124 protruding from the paper feed tray 20 toward the back, putting a ridge 122 therebetween.

Further, in the pressing member 130, a roller member 131 that comes in contact with the slopes 121 and 123 of the slope member 120 is positioned at an end of an arm member 132 rotatably held to the image forming apparatus body 70 by a rotation shaft 133, to thereby energize the arm member 132 by a tension spring 134. In the pushing device having such a configuration, a downward force F acts on the roller member 131, and at a point of contact with the slope 121, the downward force F acts on the slope 121, and an extrusion force F4 acts on the paper feed tray 20 (see FIGS. 13B and 13D). A size of the extrusion force F4 is mainly determined by gradients of the slopes 121 and 123, and the extrusion force F4 becomes a main force to move the paper feed tray 20 horizontally.

As shown in FIGS. 13A and 13B, in the stored state, a backward extrusion force F4 acts on the paper feed tray 20, and the paper feed tray 20 bumps against the stopper 72 and is positioned. On the other hand, when the paper feed tray 20 is drawn out by the handle 110 against the backward force, the roller member 131 ascends the slope 121, and when the roller member 131 passes the ridge 122, the roller member 131 comes in contact with a downhill slope 123, and a forward extrusion force F4 acts on the paper feed tray 20.

Also in this example, because the force acting on the paper feed tray 20 is different for each of a state where the roller member 131 ascends the slope 121, a state where the roller member 131 descends the slope 123, and a state where the roller member 131 comes off the slope 121, the user feels the difference as a change of the operating force.

As described above, there is a problem that user's operational feeling is not good due to a change of the operating force, at the time of drawing out the paper feed tray positioned and arranged in the image forming apparatus. Particularly, as in the tandem tray, when a plurality of paper feed trays are arranged, two different operations of releasing the locking device and thereafter drawing out the paper feed tray are required for drawing out the stored paper feed tray. Therefore, an impact accompanying the movement of the paper feed tray and a change of the operating force cannot be avoided during one operation performed by the user such as pulling the handle. When right and left two trays of the tandem tray are to be drawn out simultaneously, the impact and the change of the operating force are accumulated, and thus the unpleasant feeling caused on the user can be increased.

SUMMARY OF THE INVENTION

It is an object of the present invention to at least partially solve the problems in the conventional technology.

According to an aspect of the present invention, there is provided a locking device for locking or separating a first paper feed tray to a second paper feed tray in a state where the first paper feed tray and the second paper feed tray being arranged in parallel at a storage position of an image forming apparatus. The locking device includes an engaging mechanism having an interlocked state and a separated state. When the engaging mechanism is in the interlocked state, the first paper feed tray and the second paper feed tray are coupled to each other so that when a drawing tray between the first paper feed tray and the second paper feed tray is drawn out from the storage position, other paper feed tray is also drawn out along with the drawing tray as a drawn tray. When the engaging mechanism is in the separated state, the first paper feed tray and the second paper feed tray are separated from each other so that the first paper feed tray or the second paper feed tray is drawn out from the storage position independently of other. The engaging mechanism being configured so that, when the engaging mechanism is in the interlocked state, and when the drawing tray is drawn out from the storage position, the drawn tray is drawn out after the drawing tray is drawn out for a predetermined distance from the storage position.

According to another aspect of the present invention, there is provided an image forming apparatus including a first paper feed tray, a second paper feed tray and a locking device for locking or separating the first paper feed tray to the second paper feed tray in a state where the first paper feed tray and the second paper feed tray being arranged in parallel at a storage position of the image forming apparatus. The locking device includes an engaging mechanism having an interlocked state and a separated state. When the engaging mechanism is in the interlocked state, the first paper feed tray and the second paper feed tray are coupled to each other so that when a drawing tray between the first paper feed tray and the second paper feed tray is drawn out from the storage position, other paper feed tray is also drawn out along with the drawing tray as a drawn tray. When the engaging mechanism is in the separated state, the first paper feed tray and the second paper feed tray are separated from each other so that the first paper feed tray or the second paper feed tray is drawn out from the storage position independently of other. The engaging mechanism being configured so that, when the engaging mechanism is in the interlocked state, and when the drawing tray is drawn out from the storage position, the drawn tray is drawn out after the drawing tray is drawn out for a predetermined distance from the storage position.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 1A is a schematic diagram of a stored state of a paper feed tray and FIG. 1B is a schematic diagram of a drawn out state thereof;

FIG. 2A is a graph of a drawing force in case of drawing out a single paper feed tray, FIG. 2B is a graph of a drawing force in case of drawing out two paper feed trays that are coupled with the conventional locking device, and FIG. 2C is a graph of a drawing force in case of drawing out two paper feed trays that are coupled with the locking device according to the first embodiment;

FIG. 3A is a graph of a force for drawing out a single second paper feed tray, FIG. 3B is a graph of a force for drawing out a single first paper feed tray, FIG. 3C is a graph of a drawing force when two paper feed trays are drawn out simultaneously, and FIG. 3D is a graph of a drawing force when two paper feed trays are drawn out by using the locking device according to the second embodiment;

FIG. 4A is a schematic diagram of a stored state of a paper feed tray and FIG. 4B is a schematic diagram of a drawn out state thereof;

FIG. 5A is a schematic diagram of a stored state of a paper feed tray and FIG. 5B is a schematic diagram of a drawn out state thereof;

FIG. 10A is a schematic diagram of an interlocked state and FIG. 10B is a schematic diagram of an operation to shift from a released state to the interlocked state;

FIG. 11A is a plan view of a state where coupling is released and one of the two paper feed trays is drawn out, and FIG. 11B is a plan view of a state where the two paper feed trays are drawn out in an interlocked state;

FIG. 12A is a schematic diagram of a state where a paper feed tray is stored, and FIG. 12B is a schematic diagram of a state where the paper feed tray is pushed out; FIG. 13A is a schematic diagram of a stored state of a paper feed tray, FIG. 13B depicts a state of a force in the stored state, FIG. 13C is a schematic diagram of a pushed state of the paper feed tray, and FIG. 13D depicts a state of a force in the pushed state.

DETAILED DESCRIPTION OF THE PREFERRED EMBODIMENTS

Exemplary embodiments of the present invention will be explained below in detail with reference to the accompanying drawings.

Figure 1A:
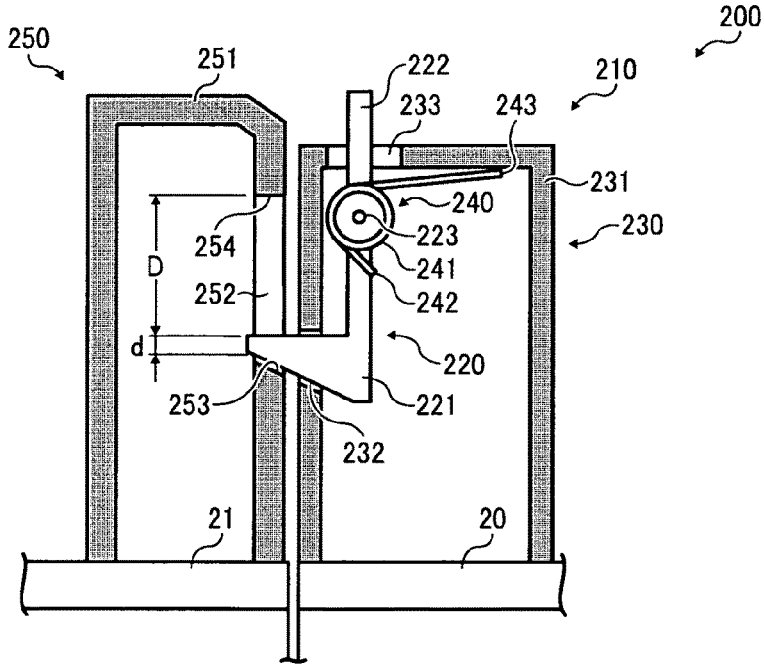
FIGS. 1A and 1B depict a locking device of a paper feed tray according to a first embodiment of the present invention, where
Figure 1B:
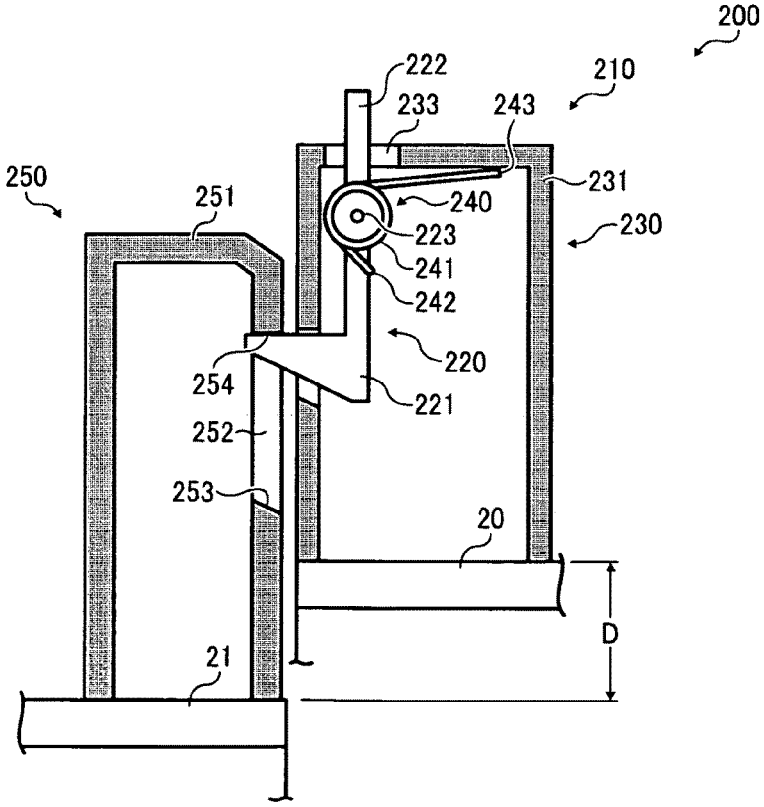

A locking device of a paper feed tray and an image forming apparatus including the same according to a first embodiment of the present invention are explained below. FIGS. 1A and 1B depict a locking device 200 according to the first embodiment, where FIG. 1A is a schematic diagram of depicts a stored state of the paper feed tray and FIG. 1B is a schematic diagram of a drawn out state thereof. The locking device 200 is installed in an image forming apparatus, which adopts a tandem tray including two paper feed trays as shown in a conventional example. The locking device 200 can be set to an interlocked state where first and second paper feed trays 20 and 21 are coupled so that when the first paper feed tray 20 is drawn out as a drawing tray, the second paper feed tray 21 is also drawn out as a drawn step, or to a separated state where the two paper feed trays 20 and 21 can be individually drawn out. In the respective paper feed trays 20 and 21, the paper-feed-tray pushing device (see FIGS. 13A to 13D and 12A and 12B, respectively) explained in the conventional example is arranged.

The locking device 200 includes an operating unit 210 installed in the first paper feed tray 20, and a latching unit 250 installed in the second paper feed tray 21. The operating unit 210 and the latching unit 250 are arranged in the first and second paper feed trays 20 and 21 so as to be adjacent to each other.

The operating unit 210 includes a rotatable latching member 220, a box unit 230 in which the latching member 220 is rotatably supported, and a helical spring 240 that energizes the latching member 220 to one direction. All these components are arranged within a box-shaped casing 231 of the box unit 230. The latching member 220 is rotatably supported by a shaft 223 in the box unit 230 and it has an engagement claw portion 221 formed at one end and an operating portion 222 formed at other end thereof. An engagement-claw member hole 232 through which the engagement claw portion 221 comes in and out and an operating hole 233 through which the operating portion 222 protrudes are provided in the casing 231. A winding unit 241, i.e., the helical spring 240, is wound around the shaft 223, one end 242 thereof is latched on the engagement claw portion 221 side of the latching member 220, and other end 243 thereof made to abut with an inner wall of the casing 231, to energize the engagement claw portion 221 of the latching member 220 so that the engagement claw portion 221 protrudes from the engagement-claw member hole 232.

The latching unit 250 has a box-shaped casing 251. An engagement hole 252, into which the engagement claw portion 221 of the latching member 220 is inserted, is formed in the casing 251. The engagement hole 252 includes a back-side contact surface 253 and a near-side contact surface 254. The back-side contact surface 253 and the near-side contact surface 254 define an engaging step with which the engagement claw portion 221 engages. The length (D+d) of the engagement hole 252 in an insertion direction, that is, a dimension from the back-side contact surface 253 to the near-side contact surface 254, is longer than a thickness d of the engagement claw portion 221 that goes inside the engagement hole 252. Therefore, when the first and second paper feed trays 20 and 21 are in the stored state, as shown in FIG. 1A, the box unit 230 and the latching unit 250 are adjacent to each other, so that the engagement claw portion 221 is located near the back-side contact surface 253 of the engagement hole 252, and is located away from the back-side contact surface 253 of the engagement hole 252 by a length D.

In the state shown in FIG. 1A, i.e., when the locking device 200 is in an interlocked state, the first and second paper feed trays 20 and 21 coupled with each other. When the first and second paper feed trays 20 and 21 are to be drawn out, the second paper feed tray 21 is automatically drawn out by drawing out the first paper feed tray 20. More specifically, as shown in FIG. 1B, when the second paper feed tray 21 is drawn out for a length D, the engagement claw portion 221 of the latching member 220 comes in contact with the near-side contact surface 254 of the engagement hole 252, and when the second paper feed tray 21 is drawn out further, the first paper feed tray 20 is drawn out along with the second paper feed tray 21. The length D is preferably equal to or longer than a distance from the stored state (FIG. 1A) until the operating force of the second paper feed tray is stabilized.

When the operating portion 222 is operated to rotate the latching member 220, draw in the engagement claw portion 221, and pull out the engagement claw portion 221 from the engagement hole 252, engagement between the box unit 230 and the latching unit 250 is released. The first and second paper feed trays 20 and 21 are separated, so that the respective paper feed trays 20 and 21 can be individually drawn out.

Figure 2A:
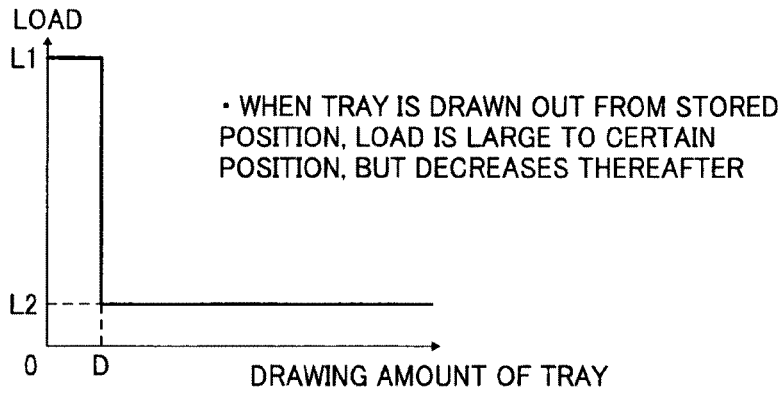
FIGS. 2A to 2C are graphs for explaining an operating force accompanying a movement of the paper feed tray, where
Figure 2B:
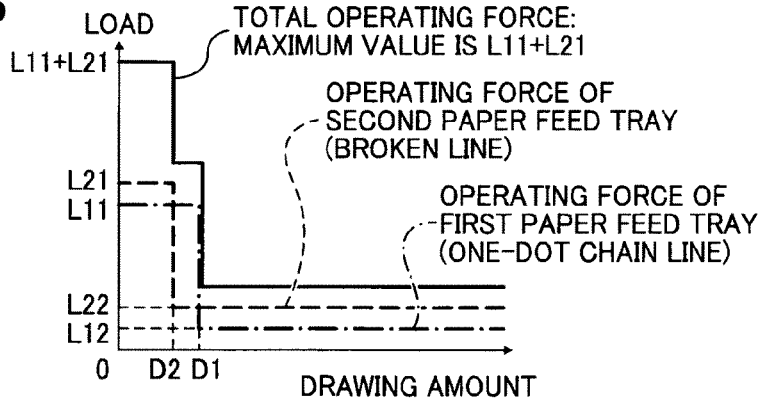
Figure 2C:
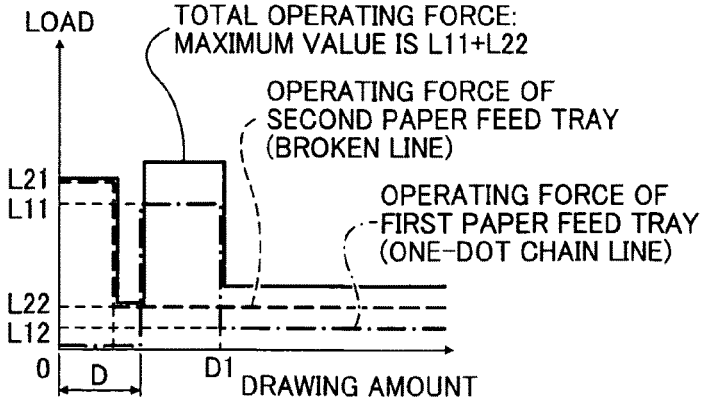

How much drawing force is required to draw out the paper feed trays according to the first embodiment is explained next. FIGS. 2A to 2C are graphs for explaining an operating force accompanying the movement of the paper feed tray in the locking device, where FIG. 2A is a graph of the drawing force of a single paper feed tray, FIG. 2B is a graph of the drawing force when a conventional locking device including two paper feed trays is used, and FIG. 2C is a graph of the drawing force when the locking device according to the first embodiment is used. In these examples, as the paper-feed-tray pushing device, one using the slope member and the roller member (see FIGS. 13A to 13D, and 12A and 12B) is arranged in the respective paper feed trays 20 and 21.

In each graph of FIG. 2A to 2C, a drawing amount of the paper feed tray is plotted on the horizontal axis (the storage position is set to 0), and a load with respect to the operating force is plotted on the vertical axis. The load with respect to the operating force includes (1) a force required for the roller member 131 to ascend the slope member 120, (2) a frictional resistance at the time of fitting a guide pin provided on the image forming apparatus body side for positioning of the paper feed tray in a vertical direction and a sheet transport direction into a hole or a groove provided on the paper feed tray side, and (3) a frictional resistance at the time of fitting a connector for electrical connection with the image forming apparatus body into the paper feed tray when there is electrical equipment such as a motor and a sensor.

A relation between the drawing amount of the respective paper feed trays and the load is explained below. In the region where the drawing amount of the paper feed tray is from 0 to D, the loads described above are overlapped. Therefore, a line expressing the load is actually a complicated curve; however, for simplifying the explanation, the line is expressed as a straight line. It is assumed that the initial load is L1 as shown in FIG. 2A. When the drawing amount of the paper feed tray exceeds D, no load acts; therefore, the only load that acts is a sliding resistance L2 of a rail. FIG. 2A depicts a case that the locking device is in the separated state and only one paper feed tray is to be drawn out.

FIG. 2B depicts an operating force required for drawing out two paper feed trays simultaneously that are coupled with the conventional locking device, and FIG. 2C depicts an operating force required for drawing out two paper feed trays that are coupled with the locking device according to the first embodiment. From FIGS. 2B and 2C, it is understood that the maximum value of the operating force is L11+L21 in the conventional case, whereas the maximum value is L11+L22 in the present invention. Moreover, because L21>L22, an absolute value of the operating force decreases and an unpleasant feeling caused on a user decreases in the present invention. D1 and D2 represent drawing out distances at which the total operating force changes.

Figure 3A:
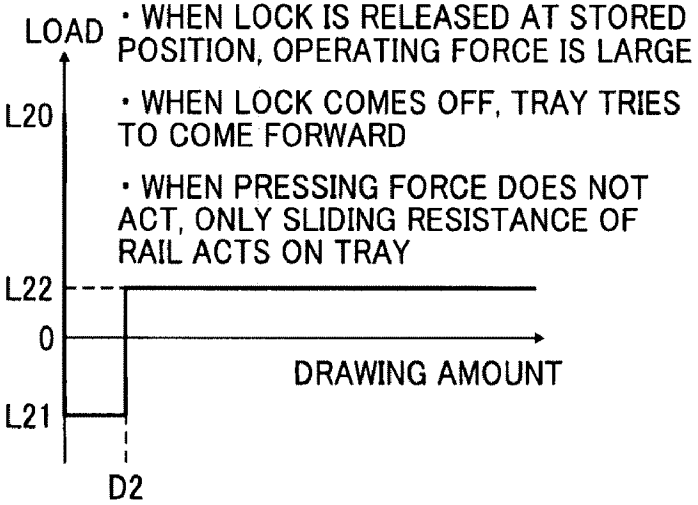
FIGS. 3A to 3D are graphs for explaining an operating force accompanying a movement of a paper feed tray in a locking device of a paper feed tray according to a second embodiment of the present invention, where
Figure 3B:
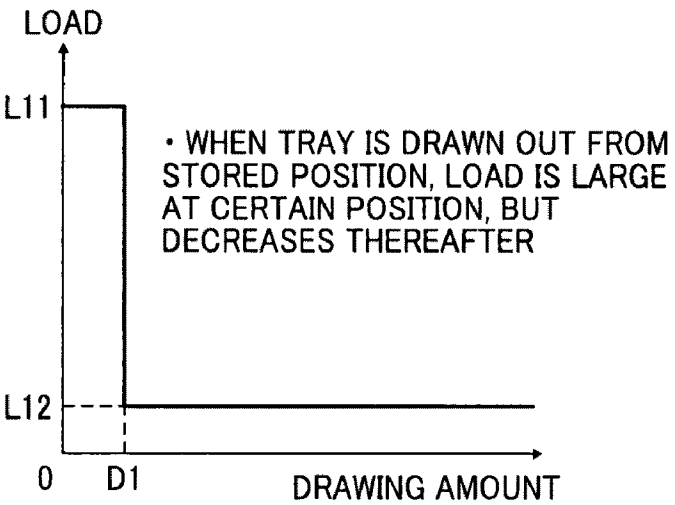
Figure 3D:
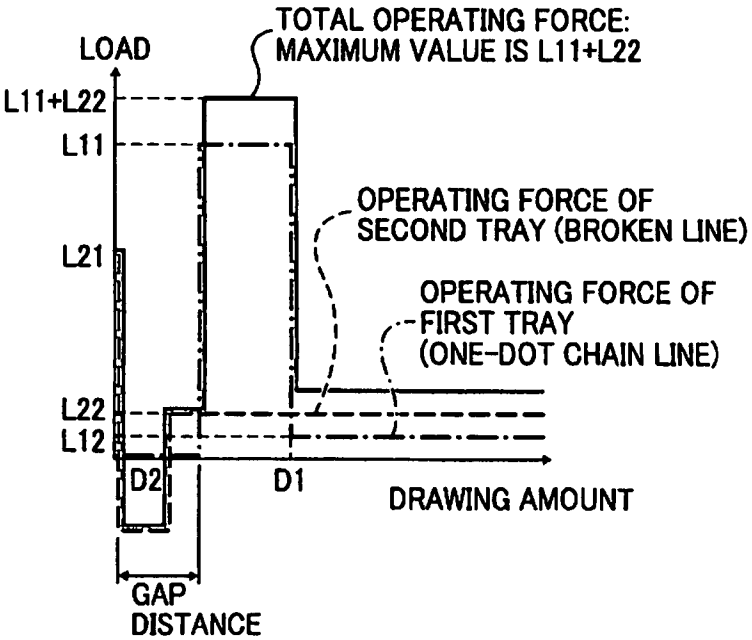
Figure 3C:
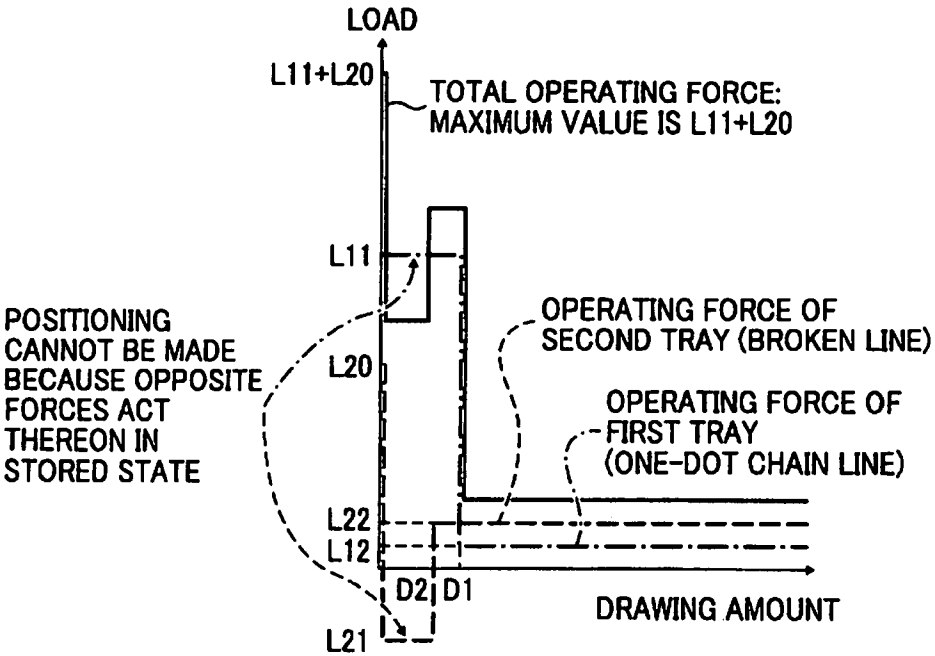

A drawing force of a paper feed tray according to a second embodiment of the present invention is explained next. FIGS. 3A to 3D are schematic diagrams for explaining an operating force accompanying the movement of the paper feed tray in a locking device of the paper feed tray according to the second embodiment, where FIG. 3A is a graph of a force for drawing out a single second paper feed tray, FIG. 3B is a graph of a force for drawing out a single first paper feed tray, FIG. 3C is a graph of a drawing force when the two paper feed trays are drawn out simultaneously, and FIG. 3D is a graph of a drawing force when the two paper feed trays are drawn out by using the locking device according to the second embodiment. In these examples, as the paper-feed-tray pushing device, the one using the slope member and the roller member (see FIGS. 13A to 13D) is arranged in the first paper feed tray 20 and the one using the compression spring (see FIGS. 12A and 12B) is arranged in the second paper feed tray 21.

When the locking device is in the separated state, and only one of the paper feed trays is to be drawn out, the relation between the drawing amount and the load is as shown below. When the second paper feed tray is to be drawn out, as shown in FIG. 3A, the drawing force of the paper feed tray is required for removing the locking device for positioning the paper feed tray by operating the handle, and when the locking device is removed, the paper feed tray is pushed out to the near side. When a direction toward the near side is designated as "+" (positive) to express the load, the load becomes "−" (negative). Further, in the section where the drawing amount of the paper feed tray is from 0 to D, the loads due to other factors are overlapped, and a line expressing the load is actually a complicated curve. However, for simplifying the explanation, the line is expressed as a straight line having a certain value L1 as shown in FIG. 3A. When the paper feed tray is drawn out by a certain amount, the above-described force does not act, and thus only a sliding resistance L2 of the rail becomes the load. In FIG. 3A, D2 is a drawing out length of the second paper feed tray at which the load to the second paper feed tray becomes constant and the constant load is only a sliding resistance of the rail. When the first paper feed tray is to be drawn out, as shown in FIG. 3B, the same thing applies as in FIG. 2A. In FIG. 3B, D1 shows a drawing out length of the first paper feed tray at which the load to the first paper feed tray becomes constant and the constant load is only a sliding resistance of the rail.

When the two paper feed trays are to be drawn out simultaneously in a case that a conventional locking device is in the interlocked state, as shown in FIG. 3C, the load becomes a state adding FIGS. 3A and 3B. On the other hand, when the locking device according to the second embodiment is used and it is set such that the first paper feed tray starts to move after the second paper feed tray is drawn out and only the sliding resistance of the rail is acting, the maximum value of the operating force becomes L11+L22 in the second embodiment, whereas it is L11+L20 in the conventional technique. In many cases, because L20>L22, the maximum value of the operating force required for a user decreases in the second embodiment, thereby reducing the unpleasant feeling caused on the user.

In this case, there is such a problem that at the time of releasing the lock by the handle, a forward force acting on the second paper feed tray and a backward force acting on the first paper feed tray are offset unless it is set such that the two paper feed trays start to move with a distance therebetween, and a force required for positioning the paper feed trays cannot be obtained. A mechanism in which two paper feed trays start to move with a distance therebetween has such an advantage that the mechanism shown in this example is realized.

Figure 4A:
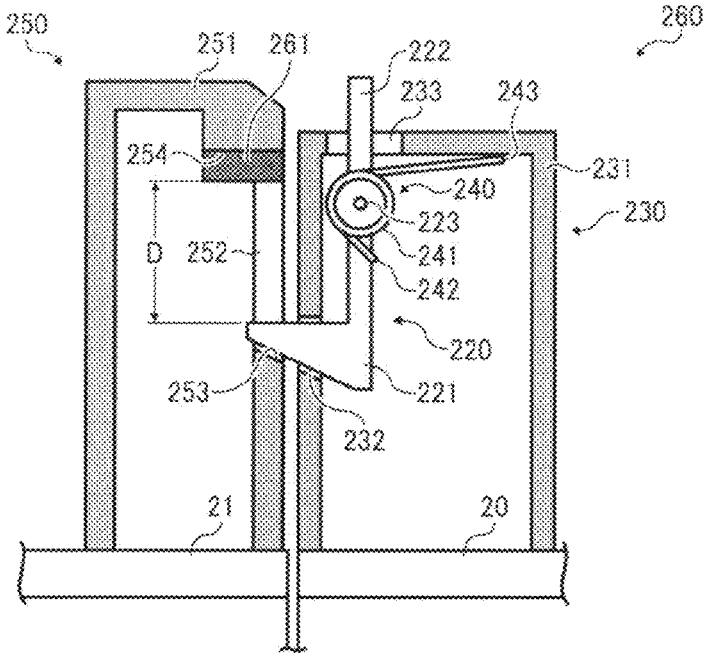
FIGS. 4A and 4B depict a locking device of a paper feed tray according to a modification of the second embodiment, where
Figure 4B:
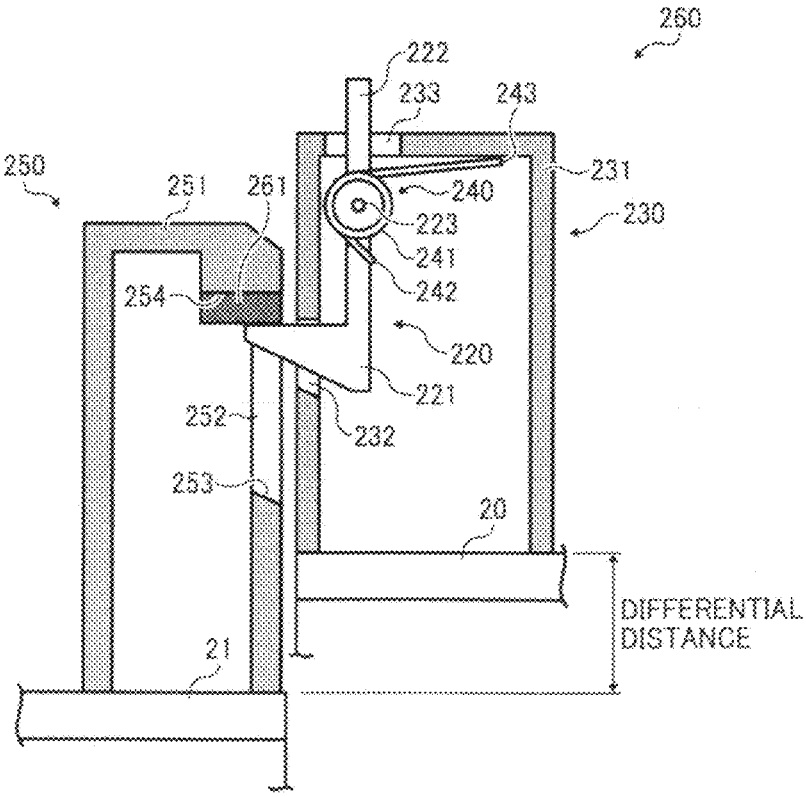

A modification of the second embodiment is explained next. FIGS. 4A and 4B depict a locking device 260 of a paper feed tray according to the modification, where FIG. 4A is a schematic diagram of a stored state and FIG. 4B is a schematic diagram of a drawn out state. In the locking device 260, buffer material 261 is arranged on the near-side contact surface 254 of the latching unit 250. As a result, an impact when the second paper feed tray 21 is drawn out and the engagement claw portion 221 comes in contact with the near-side contact surface 254 can be alleviated, thereby enabling to improve its operational feeling.

Figure 5A:
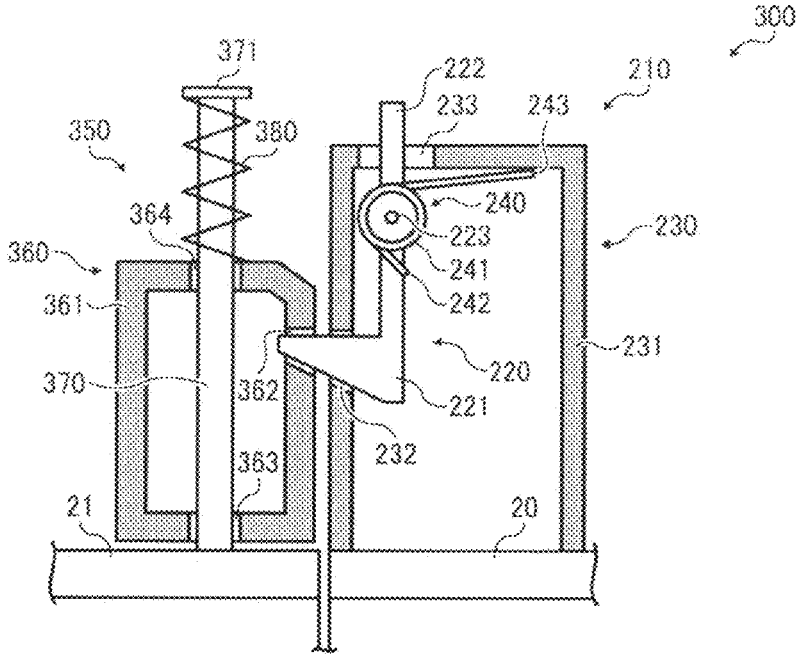
FIGS. 5A and 5B depict a locking device of a paper feed tray according to a third embodiment of the present invention, where
Figure 5B:
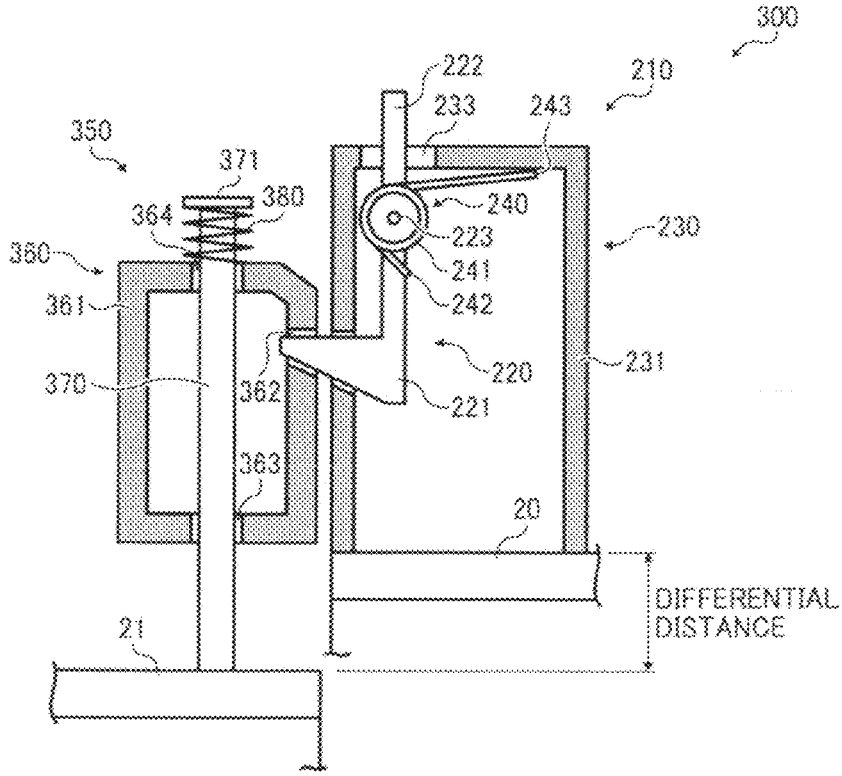

A locking device of a paper feed tray according to a third embodiment of the present invention is explained next. FIGS. 5A and 5B depict a locking device 300 of a paper feed tray according to a third embodiment, where FIG. 5A is a schematic diagram of a stored state and FIG. 5B is a schematic diagram of a drawn out state. The locking device 300 includes a latching unit 350 and the operating unit 210 according to the first embodiment. The configuration of the operating unit 210 is the same as that of the locking device 200 according to the first embodiment, and thus detailed explanations thereof will be omitted.

The latching unit 350 is configured by slidably fitting a box-like member 360 to a support 370 arranged in a standing condition in the second paper feed tray 21. The latching unit 350 includes an engagement hole 362 engaging with the engagement claw portion 221, and a box-shaped casing 361 with two insertion holes 363 and 364, through which the support 370 is fitted by insertion. The support 370 has a length enough to move the box-like member 360 by a dimension D with a guard 371 being formed at an end thereof, and includes a coil spring 380 arranged between the guard 371 and the box-like member 360. It is desired for improving the operational feeling that a spring force of the coil spring 380 is slightly larger than a sliding resistance of the first paper feed tray 20.

The locking device 300 operates as follows. When a user pulls a handle, the second paper feed tray 21 starts to move. At this time, the coil spring 380 contracts, and the first paper feed tray 20 does not move. When the coil spring 380 contracts completely, the first paper feed tray 20 also starts to move, and thereafter, the coil spring 380 regains an original length and a relative position of both of the paper feed trays returns to an original position. When the second paper feed tray 21 is completely drawn out, the first paper feed tray 20 is also completely drawn out.

When the paper feed trays are drawn out in the interlocked state, it is not desirable that a drawing amount of the first paper feed tray 20 is smaller than that of the second paper feed tray 21 by a difference of a travel distance, from a standpoint of performing a sheet supply operation. In the third embodiment, after the paper feed trays are drawn out, the second paper feed tray 21 is drawn out due to an energizing force of the coil spring 380, the relative position of the paper feed trays returns to the original relative position, and the drawing amount of the paper feed trays becomes the same, so that easiness of supply of sheets becomes the same in both of the paper feed trays.

A locking device of a paper feed tray according to a fourth embodiment is explained next. In the image forming apparatus including the first and second paper feed trays 20 and 21, when the first and second paper feed trays 20 and 21 are to be stored in the image forming apparatus from a state where the first and second paper feed trays 20 and 21 are drawn out, the second paper feed tray 21 abuts against the first paper feed tray 20 to push the first paper feed tray 20. At this time, the second paper feed tray 21 bumps against the first paper feed tray 20 in an energized state, in a state where the two paper feed trays 20 and 21 can move relative to each other. Therefore, the impact is transmitted to the user performing a storage operation, and the operational feeling may deteriorate. In the fourth embodiment, therefore, a buffer material is arranged at a contact portion between the paper feed trays 20 and 21 to alleviate the impact.

Figure 6:
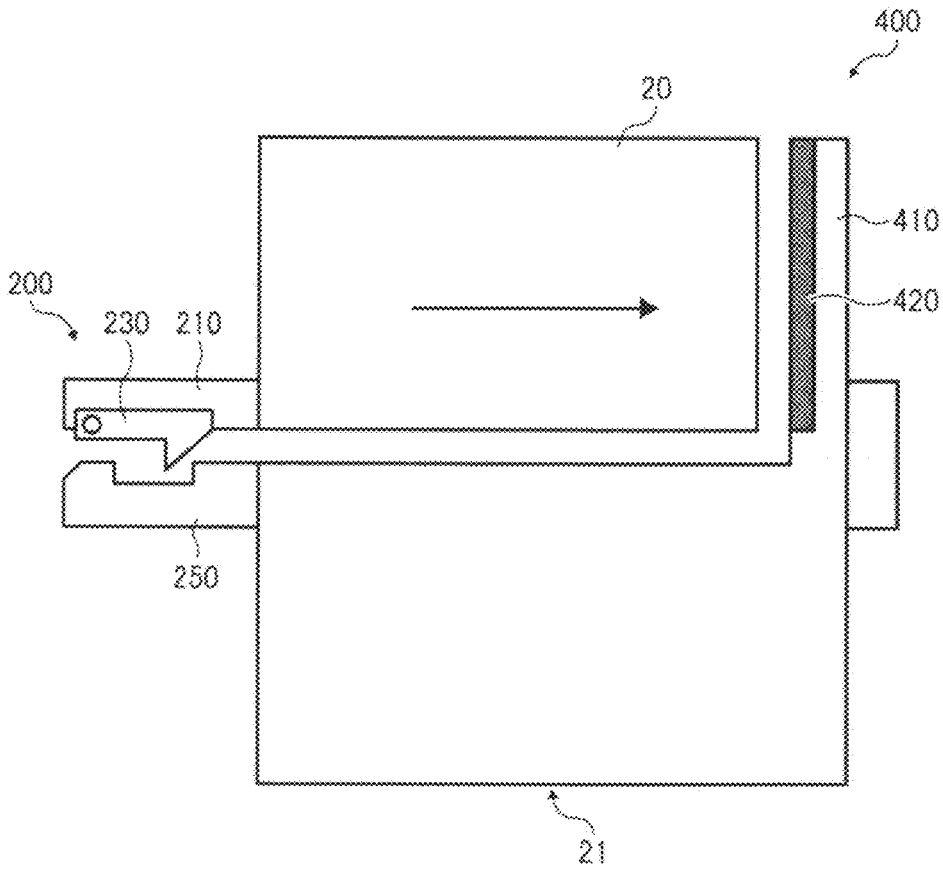
FIG. 6 is a schematic diagram of a locking device of a paper feed tray according to a fourth embodiment of the present invention.
Figure 7:
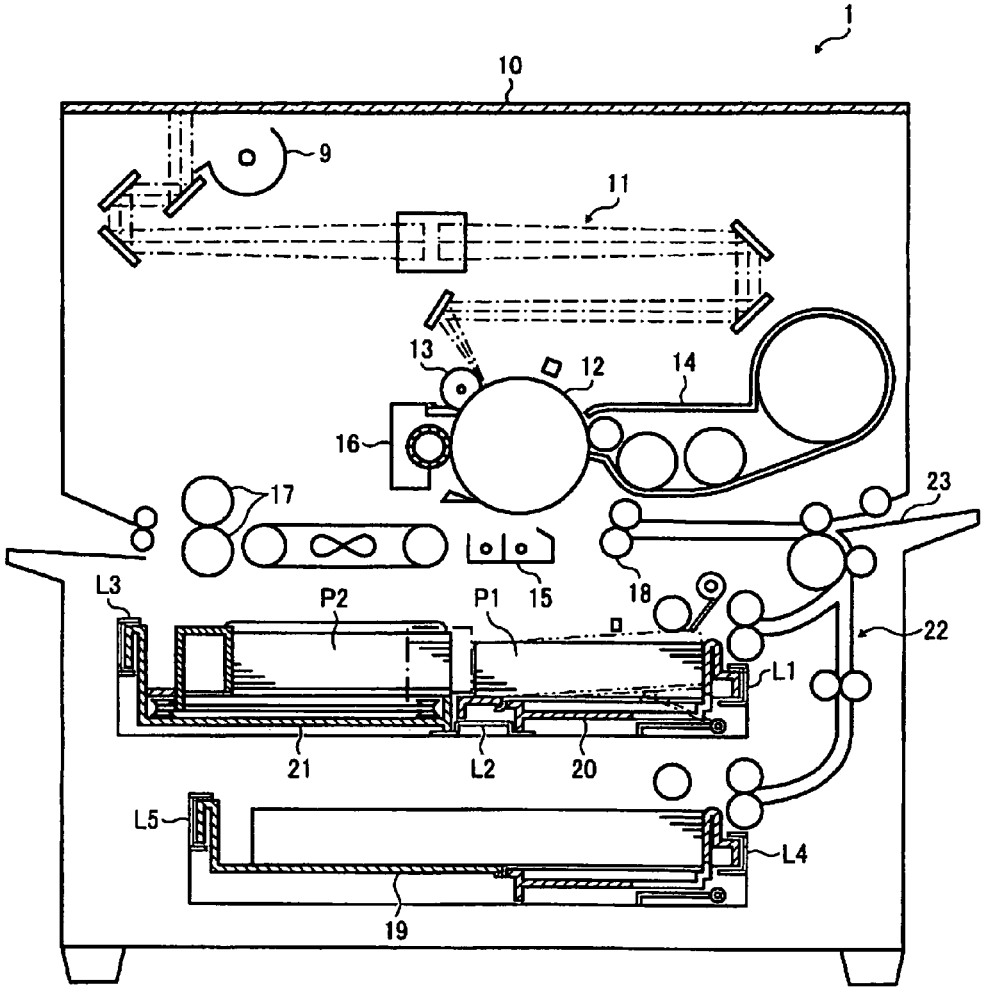
FIG. 7 CONVENTIONAL ART
FIG. 7 is a sectional view of an image forming apparatus (copying machine) with a tandem tray incorporated therein.
Figure 8:
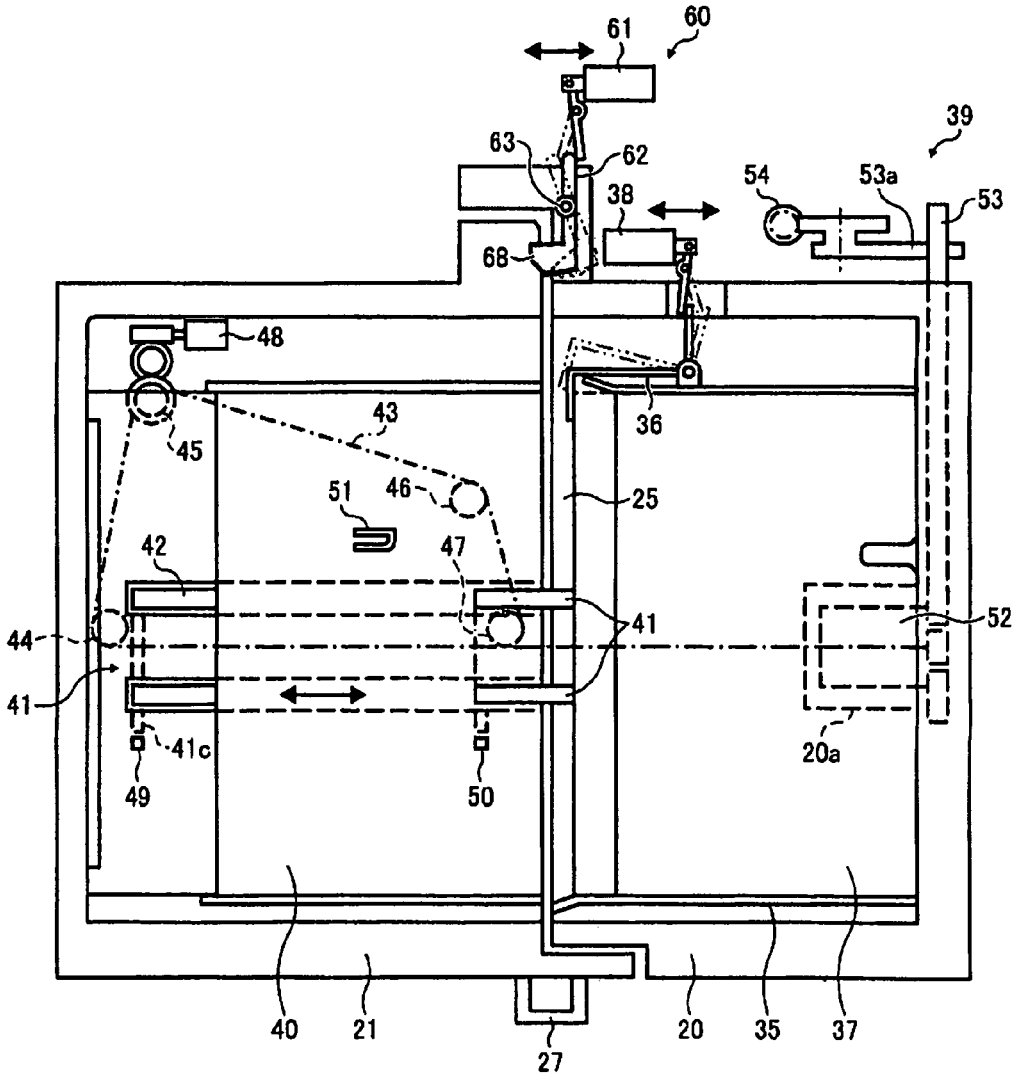
FIG. 8 is a plan view of an entire configuration of a paper feed unit at the time of storing paper feed trays in the image forming apparatus shown in FIG. 7.
Figure 9:
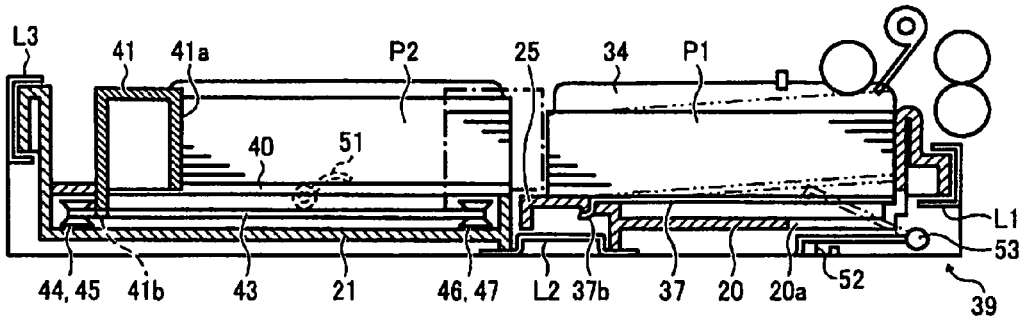
FIG. 9 is a front view of a transfer paper storage unit.
Figure 10A:
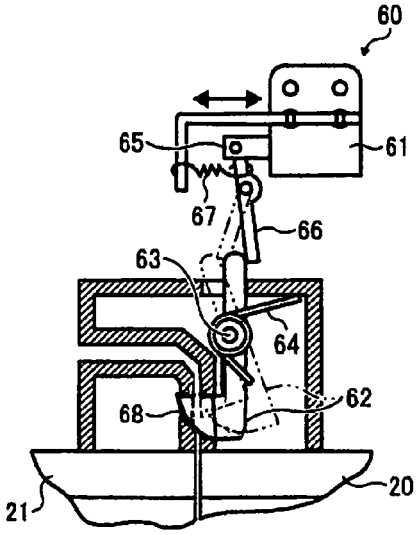
FIGS. 10A and 10B depict a state of a locking mechanism employed in a conventional image forming apparatus at the time of storage, where
Figure 10B:
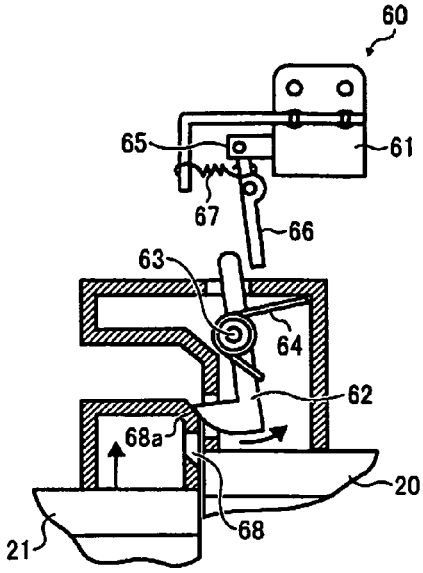
Figure 11B:
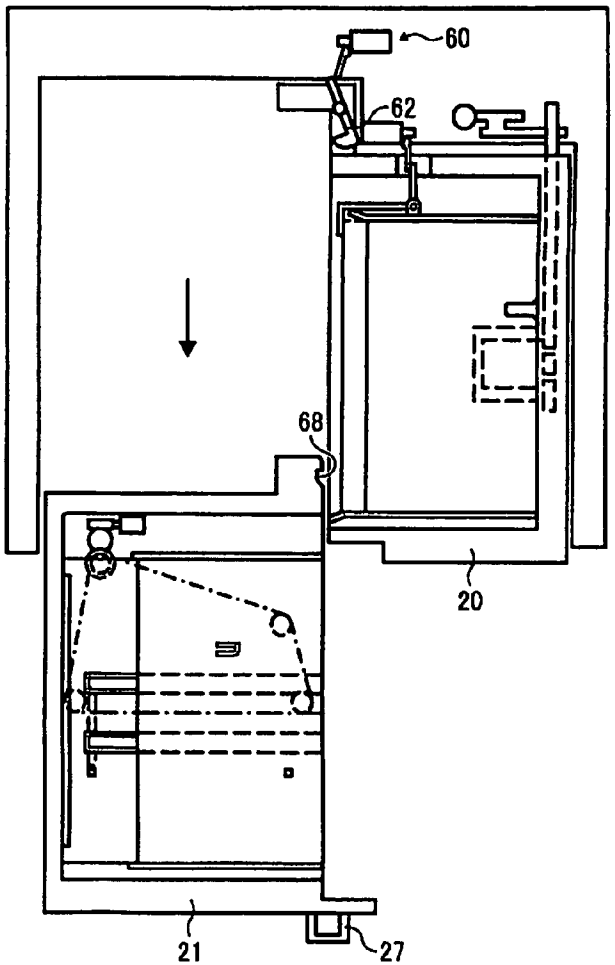
FIG. 11B CONVENTIONAL ART
FIGS. 11A and 11B depict a movement of two paper feed trays employed in a conventional image forming apparatus, where
Figure 11A:
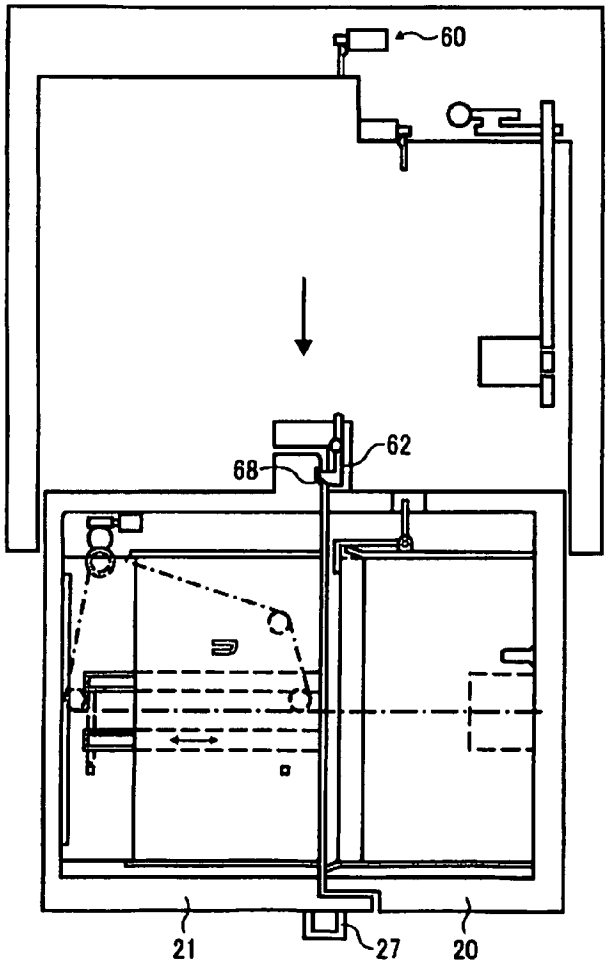
FIG. 11A CONVENTIONAL ART
Figure 12A:
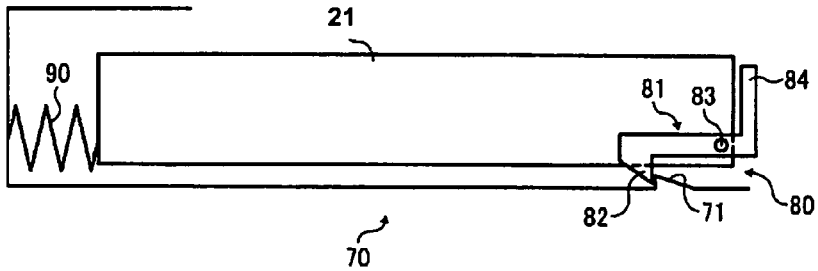
FIG. 12A CONVENTIONAL ART
FIGS. 12A and 12B depicts a paper-feed-tray pushing device, where
Figure 12B:
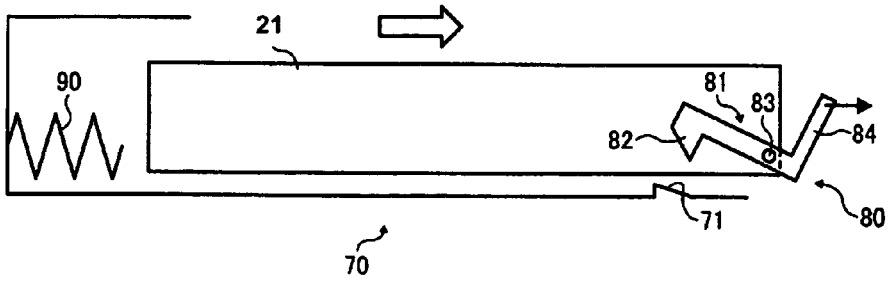
FIG. 12B CONVENTIONAL ART
Figure 13A:
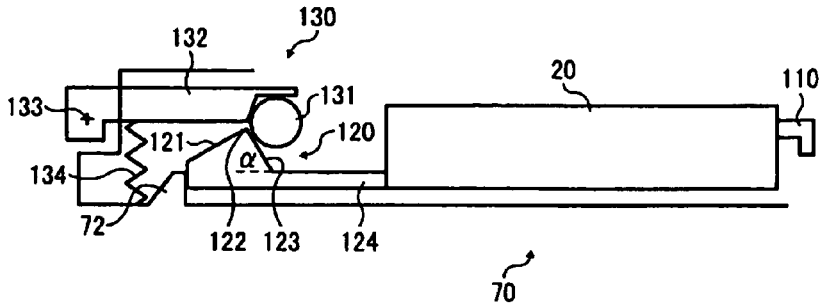
FIG. 13A CONVENTIONAL ART
FIGS. 13A to 13D depict another conventional paper-feed-tray pushing device, where
Figure 13B:
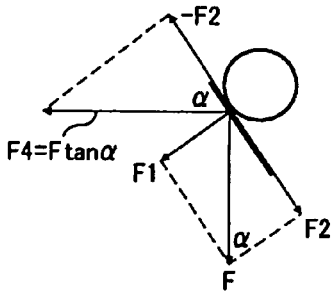
FIG. 13B CONVENTIONAL ART
Figure 13C:
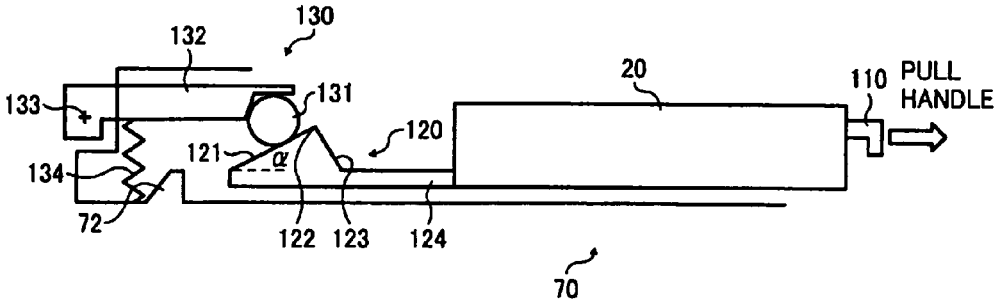
FIG. 13C CONVENTIONAL ART
Figure 13D:
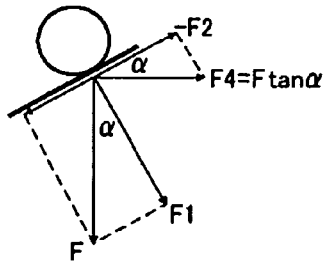
FIG. 13D CONVENTIONAL ART

FIG. 6 is a schematic diagram of a locking device 400 of a paper feed tray according to the fourth embodiment. In the locking device 400, the locking device 200 is provided, an extending portion 410 is formed in the second paper feed tray 21, and a buffer member 420 formed of, for example, an elastic resin is arranged in the extending portion 410. When the paper feed trays 20 and 21 are to be stored, because the first paper feed tray 20 abuts against the buffer member 420 of the extending portion 410, the impact is alleviated and the impact transmitted to the user is reduced, thereby improving the operational feeling.

According to the embodiments explained above, at the time of drawing out two paper feed trays, the second paper feed tray is drawn out after the first paper feed tray is drawn out by a predetermined amount. Therefore, in the tandem tray to which a plurality of paper feed trays are coupled or separated and drawn out, a change of the operational feeling can be set with greater flexibility, and an unpleasant feeling caused on the user at the time of drawing out the paper feed tray can be reduced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A paper feed tray locking device of an image forming apparatus, comprising:

an engaging mechanism configured to switch between an interlocked state and a separated state, wherein the engaging mechanism is configured such that, when the engaging mechanism is in the interlocked state, a first paper feed tray and a second paper feed tray are coupled to each other so that when a drawing tray that is one of the first paper feed tray and the second paper feed tray is drawn out from a storage position, other paper feed tray of the first paper feed tray and the second paper feed tray is also drawn out along with the thawing tray as a drawn tray, when the engaging mechanism is in the separated state, the first paper feed tray and the second paper feed tray are separated from each other so that one of the first paper feed tray and the second paper feed tray is drawn out from the storage position independently of other of the first paper feed tray and the second paper feed tray, and when the engaging mechanism is in the interlocked state, and when the drawing tray is drawn out from the storage position, the drawn tray is drawn out after the drawing tray is drawn out a distance from the storage position.

2. The paper feed tray locking device according to claim 1, wherein the engaging mechanism includes an engaging member on one of the first paper feed tray and the second paper feed tray; and a to-be-engaged member on a different one of the first paper feed tray and the second paper feed tray than the engaging member.

3. The paper feed tray locking device according to claim 2, wherein the engaging member includes an engagement claw member, the to-be-engaged member includes an engaging step configured to engage with the claw member, and the engaging mechanism is configured to, when the engaging mechanism is in the interlocked state with both the first paper feed tray and the second paper feed tray being positioned at the storage position, secure a gap equivalent to the distance between the engagement claw member and the engaging step in a direction of drawing out the drawing tray.

4. The paper feed tray locking device according to claim 3, wherein a buffer material is in at least one of the engagement claw member and the engaging step.

5. The paper feed tray locking device according to claim 2, wherein the engaging member includes an engagement claw member, the to-be-engaged member includes an engaging step configured to engage with the claw member, and an energizing member is in the drawn tray, the energizing member including a guiding member configured to guide the energizing member, the energizing member held movably by a distance in a direction of drawing out the drawing tray, the energizing member to energize the drawing tray toward the drawn tray with a pressing force.

6. The paper feed tray locking device according to claim 1, further comprising:

a pressing unit between the first paper feed tray and the second paper feed tray, the pressing unit configured to, when an inserting tray that is one of the first paper feed tray and the second paper feed tray is inserted towards the storage position, press a different one of the first paper feed tray and the second paper feed tray than the inserting tray as a pressed tray; and a buffer material at a position where the pressing unit comes in contact with the pressed tray.

7. The paper feed tray locking device according to claim 1, further comprising:

a paper-feed-tray energizing unit on an energizing paper feed tray of the first paper feed tray and the second paper feed tray, wherein the paper-feed-tray energizing unit is configured to energize a different one of the first paper feed tray and the second paper feed tray than the energizing paper feed tray from the stored position in a drawing direction.

8. An image forming apparatus, comprising:

a first paper feed tray;

a second paper feed tray; and a locking device configured to switch between the first paper feed tray to the second paper feed tray in a state where the first paper feed tray and the second paper feed tray are arranged in parallel at a storage position of the image forming apparatus, the locking device including an engaging mechanism configured to switch between an interlocked state and a separated state, wherein the engaging mechanism is configured such that, when the engaging mechanism is in the interlocked state, the first paper feed tray and the second paper feed tray are coupled to each other so that when a drawing tray that is one of the first paper feed tray and the second paper feed tray is drawn out from a storage position, other paper feed tray of the first paper feed tray and the second paper feed tray is also drawn out along with the drawing tray as a drawn tray, when the engaging mechanism is in the separated state, the first paper feed tray and the second paper feed tray are separated from each other so that one of the first paper feed tray and the second paper feed tray is drawn out from the storage position independently of other of the first paper feed tray and the second paper feed tray, and when the engaging mechanism is in the interlocked state, and when the drawing tray is drawn out from the storage position, the drawn tray is drawn out after the drawing tray is drawn out a distance from the storage position.

9. A feeding apparatus used in an image forming apparatus, comprising:

a first paper feed tray configured to draw out from a first stored position in an image forming apparatus;

a second paper feed tray configured to draw out from a second stored position in the image forming apparatus, the second stored position in parallel with the first stored position;

a first engaging member on the first paper feed tray; and a second engaging member on the second paper feed tray;

wherein the first engaging member and the second engaging member are configured to switch between a locked state in which both of the first and second engaging members are contactable to each other and an unlocked state in which the first and second engaging members are completely separated from each other, and the feeding apparatus is configured such that when the first and second engaging members are in the locked state and both of the paper feed trays are in their stored positions, the first and second engaging members are separated by a length along a drawing out direction of the first and second paper feed trays, and when the first and second engaging members are in the locked state, the second paper feed tray is drawn out by the length from the second position, and the first engaging member and the second engaging member are in contact with each other, an operating force for drawing out the second paper feed tray is transmitted to the first paper feed tray through the first engaging member and the second engaging member, and the first paper feed tray starts to move by the operating force for drawing out the second paper feed tray.

10. The feeding apparatus according to claim 9, wherein the second engaging member includes an engagement hole into which the first engaging member is inserted upon switching the first and second engaging members to the locked state, and the engagement hole is longer than the length along the drawing out direction.

11. The feeding apparatus according to claim 9, wherein the first engaging member includes a biasing member to bias the first engaging member towards the second engaging member.

12. The feeding apparatus according to claim 9, wherein the first engaging member includes an operating portion to switch the first engaging member between the locked state and the unlocked state.

13. The feeding apparatus according to claim 12, further comprising:

a driving unit to operate the operating portion.

14. The feeding apparatus according to claim 12, wherein the first engaging member and the second engaging member are on a back portion along the drawing out direction.

15. The feeding apparatus according to claim 9, further comprising:

a buffer material on at least one of contact surfaces of the first engaging member and the second engaging member.

16. A feeding apparatus used in an image forming apparatus, comprising:

a first paper feed tray configured to draw out from a first stored position in an image forming apparatus;

a second paper feed tray configured to draw out from a second stored position in the image forming apparatus, the second stored position in parallel with the first stored position;

a first engaging member on the first paper feed tray; and a second engaging member on the second paper feed tray, wherein the first engaging member and the second engaging member are configured to switch between a locked state in which both of the first and second engaging members are contactable to each other and an unlocked state in which the first and second engaging members are completely separated from each other, the second engaging member is configured to slide on a support in the second paper feed tray along a drawing out direction of the first and second paper feed trays, the support being long enough such that the second engaging member is slideable by a length towards an end of the support, the support includes a spring member between the end of the support and the second engaging member, the spring member configured to bias the second engaging member into contact with the second paper feed tray in the second stored position, and the spring member is configured to, when the first and second engaging members are switched into the locked state and after the second paper feed tray is drawn out by the length from the second stored position, to contract completely, such that the operating force for drawing out the second paper feed tray transmits to the first paper feed tray through the first engaging member, and the second engaging member and the support, and the first paper feed tray starts to move by the operating force for drawing out the second paper feed tray.

17. The feeding apparatus according to claim 16, wherein the first engaging member includes a biasing member to bias the first engaging member towards the second engaging member.

18. The feeding apparatus according to claim 16, wherein the first engaging member includes an operating portion to switch the first engaging member between the locked state and the unlocked state.

19. The feeding apparatus according to claim 18, further comprising:

a driving unit to operate the operating portion.

20. The feeding apparatus according to claim 18, wherein the first engaging member and the second engaging member are on a back portion along the drawing out direction.

21. An image forming apparatus including a feed apparatus, the feed apparatus comprising:

a first paper feed tray configured to draw out from a first stored position in an image forming apparatus, a second paper feed tray configured to draw out from a second stored position in the image forming apparatus, the second stored position in parallel with the first stored position, a first engaging member on the first paper feed tray, a second engaging member on the second paper feed tray, wherein the first engaging member and the second engaging member are configured to switch between a locked state in which both of the first and second engaging members are contactable to each other and an unlocked state in which the first and second engaging members are completely separated from each other, and the feeding apparatus is configured such that when the first and second engaging members are in the locked state and both of the paper feed trays are in their stored positions, the first and second engaging members are separated by a length along a drawing out direction of the first and second paper feed trays, and when the engaging members are in the locked state, the second paper feed tray is drawn out by the length from the second position, and the first engaging member and the second engaging member are in contact with each other, an operating force for drawing out the second paper feed tray is transmitted to the first paper feed tray through the first engaging member and the second engaging member, and the first paper feed tray starts to move by the operating force for drawing out the second paper feed tray.

22. An image forming apparatus including a feed apparatus, the feed apparatus comprising:

a first paper feed tray configured to draw out from a first stored position in an image forming apparatus;

a second paper feed tray configured to draw out from a second stored position in the image forming apparatus, the second stored position in parallel with the first stored position;

a first engaging member on the first paper feed tray; and a second engaging member on the second paper feed tray, wherein the first engaging member and the second engaging member are configured to switch between a locked state in which both of the first and second engaging members are contactable to each other and an unlocked state in which the first and second engaging members are completely separated from each other, the second engaging member is configured to slide on a support in the second paper feed tray along a drawing out direction of the first and second paper feed trays, the support being long enough such that the second engaging member is slideable by a length towards an end of the support, the support includes a spring member between the end of the support and the second engaging member, the spring member configured to bias the second engaging member into contact with the second paper feed tray in the second stored position, and the spring member is configured to, when the engaging members are switched into the locked state and after the second paper feed tray is drawn out by the length from the second stored position, to contract completely, such that the operating force for drawing out the second paper feed tray transmits to the first paper feed tray through the first engaging member, and the second engaging member and the support, and the first paper feed tray starts to move by the operating force for drawing out the second paper feed tray.

* * * * *